US011331552B2

(12) United States Patent
Waffensmith

(10) Patent No.: US 11,331,552 B2
(45) Date of Patent: May 17, 2022

(54) MODULAR TRAINING DEVICE

(71) Applicant: Omnitool, Inc., Minneapolis, MN (US)

(72) Inventor: Jeff Waffensmith, Minneapolis, MN (US)

(73) Assignee: OMNITOOL, INC., Minneapolis, MN (US)

( * ) Notice: Subject to any disclaimer, the term of this patent is extended or adjusted under 35 U.S.C. 154(b) by 429 days.

(21) Appl. No.: 16/425,531

(22) Filed: May 29, 2019

(65) Prior Publication Data

US 2019/0366180 A1 Dec. 5, 2019

Related U.S. Application Data

(60) Provisional application No. 62/677,837, filed on May 30, 2018.

(51) Int. Cl.
*A63B 69/00* (2006.01)

(52) U.S. Cl.
CPC ..... *A63B 69/0026* (2013.01)

(58) Field of Classification Search
CPC ..... A63B 69/0026; A63B 69/0024
USPC ..... 473/446; 211/22
See application file for complete search history.

(56) References Cited

U.S. PATENT DOCUMENTS 3,952,690 A * 4/1976 Rizzo ..... E01F 9/654 116/63 P
4,147,347 A 4/1979 Angove
4,491,320 A 1/1985 Smith
5,776,007 A 7/1998 Kendall et al.
5,996,802 A * 12/1999 Parker ..... A47F 7/0071 229/932
6,165,084 A 12/2000 Cranston
(Continued)

FOREIGN PATENT DOCUMENTS

CA 1305731 C 7/1992
CA 2481818 A1 3/2006
(Continued)

OTHER PUBLICATIONS

Snipers Edge; "SweetHands Hockey Stickhandling Trainer"; Website product listing; https://www.snipersedgehockey.com/collections/top-sellers/products/sweethands-hockey-stickhandling-trainer?variant=164564992025; pp. 4.
(Continued)

*Primary Examiner* — John E Simms, Jr.
*Assistant Examiner* — Rayshun K Peng
(74) *Attorney, Agent, or Firm* — Grumbles Law PLLC

(57) ABSTRACT

A modular training device for use by athletes to improve their stick-handling skills. More specifically, a modular training device comprising a main body having two side projections that are structured and configured to together define a central channel therebetween; and at least one hollow circular base portion located below the main body and structured and configured to receive and secure a hockey puck. The central channel may have a top opening and a channel floor, and each side projection may have a first tab projecting into the central channel for releasably securing an elongated object in a horizontal configuration within the central channel. The modular training device may be hollow so that it can couple with one or more additional modular training devices.

19 Claims, 13 Drawing Sheets

(56) References Cited

U.S. PATENT DOCUMENTS

| | | | | |
|---|---|---|---|---|
| 6,364,790 | B1 | 4/2002 | Carrie et al. | |
| 6,656,064 | B2 | 12/2003 | Zielinski | |
| 7,867,112 | B1 | 1/2011 | Giauque et al. | |
| 8,357,061 | B2 | 1/2013 | Quinn | |
| 2003/0098545 | A1 | 5/2003 | Webb | |
| 2006/0063615 | A1 | 3/2006 | Richardson et al. | |
| 2008/0248902 | A1 | 10/2008 | Pittorf | |
| 2011/0210573 | A1* | 9/2011 | Wright | A63B 47/02 294/209 |
| 2012/0157242 | A1 | 6/2012 | Quinn | |
| 2017/0361190 | A1* | 12/2017 | Del Monte | A63B 71/03 |

FOREIGN PATENT DOCUMENTS

| | | | | |
|---|---|---|---|---|
| CA | 2715697 | A1 | 3/2012 | |
| CA | 2727515 | A1 * | 7/2012 | A63B 69/0022 |
| CA | 2727515 | A1 | 7/2012 | |
| CA | 2992873 | A1 * | 7/2019 | A63B 59/70 |
| EP | 2606944 | B1 | 8/2015 | |

OTHER PUBLICATIONS

ReUstix; "Our Story—ReUstix™"; Website, http://www.reustix.com/ourstuff; pp. 3.

Freeman Industries Inc; "Linwood Product Catalogue"; Product Catalogue; FI-6850; pp. 20.

ACON USA, Inc.; "ACON Wave Infinity Dangler"; Website product listing; https://us.acon24.com/products/acon-wave-infinity-dangler?variant=19684615290950; pp. 4.

Hockeyshot Inc.; "Fast Hands Stickhandling Trainer Aid." Website product listing; https://www.hockeyshot.com/Fast-Hands-Stickhandling-Trainer-Aid-Fast-Hands-Pro-p/stickhandling-aid-026-pro.htm; pp. 10.

Hockeyshot Inc.; "HockeyShot Extreme Dangler." Website product listing; https://www.hockeyshot.com/HockeyShot-Extreme-Dangler-p/stickhandling-aid-028.htm; pp. 13.

Itak Sport; "Mohawke Stick Handling Tool"; Website product listing; https://itaksport.com/other-accessories/49621-mohawke-stick-handling-tool-7340068127503.html; pp. 2.

Hockey Revolution; "Hockey Revolution Stickhandling Training Aid, Equipment for Puck Control, Reaction Time and Coordination 2nd Generation;" Website product listing; https://www.amazon.com/Hockey-Revolution-Stickhandling-Equipment-Coordination/dp/B0773XLJBL; pp. 8.

* cited by examiner

FIG. 27
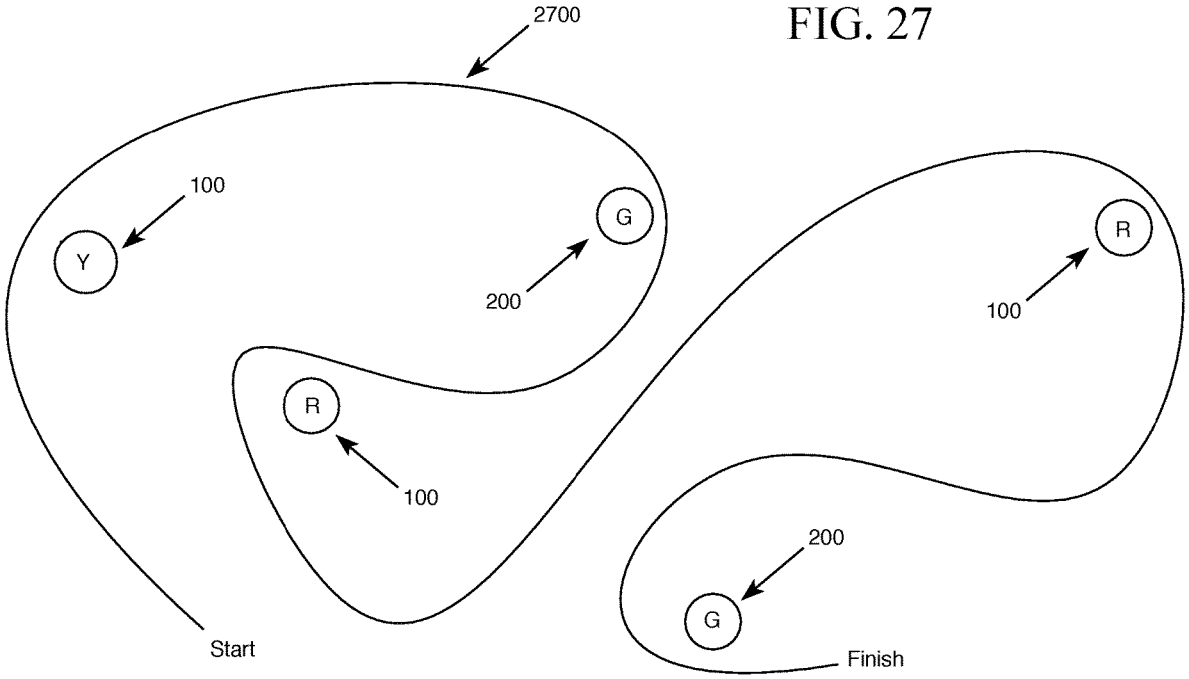
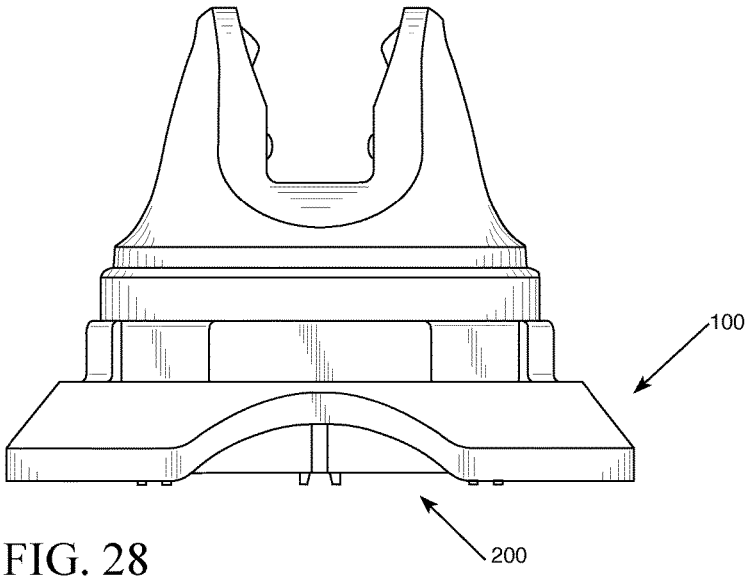
FIG. 28

MODULAR TRAINING DEVICE

CROSS-REFERENCE TO RELATED APPLICATION

This application claims the benefit of U.S. Provisional Patent Application Ser. No. 62/677,837, filed May 30, 2018 and titled MODULAR TRAINING DEVICE, which is herein incorporated by reference in its entirety.

BACKGROUND OF THE INVENTION

A main objective in the sport of hockey is to put the hockey puck into the opposing team's net. To accomplish this, players must maintain possession of the hockey puck by using a hockey stick to handle and pass the hockey puck between them. Therefore, a desired skill in the sport of hockey is the ability to hold onto and precisely pass the hockey puck. To improve this skill, teams hold practices where coaches run specific stick-handling drills for the players. Additionally, players often work on their own at home or on the ice to improve their stick-handling skills.

However, there are current limitations and disadvantages to available training tools. More specifically, the majority of available training tools have several components, may only be available in a single configuration, and/or may be heavy and, therefore, difficult to transport. Therefore, a new training tool is needed that is modular, lightweight, and transportable.

SUMMARY OF THE INVENTION

The disclosed device is a modular training device, which can be used by athletes, such as hockey players, to improve their stick-handling skills. More specifically, in one embodiment, the modular training device is comprised of a main body and at least one hollow base portion. The main body may be comprised of two side projections that, together, define a central channel, wherein the central channel has a top opening and a channel floor. The central channel may be configured to accommodate an elongated object, such as a pipe or hockey stick shaft, in a horizontal configuration. The at least one hollow base portion may be configured to receive and secure a hockey puck. In some embodiments, the modular training device may be configured to couple with a second modular training device to increase the overall height of the combination of devices.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

Figure 1:
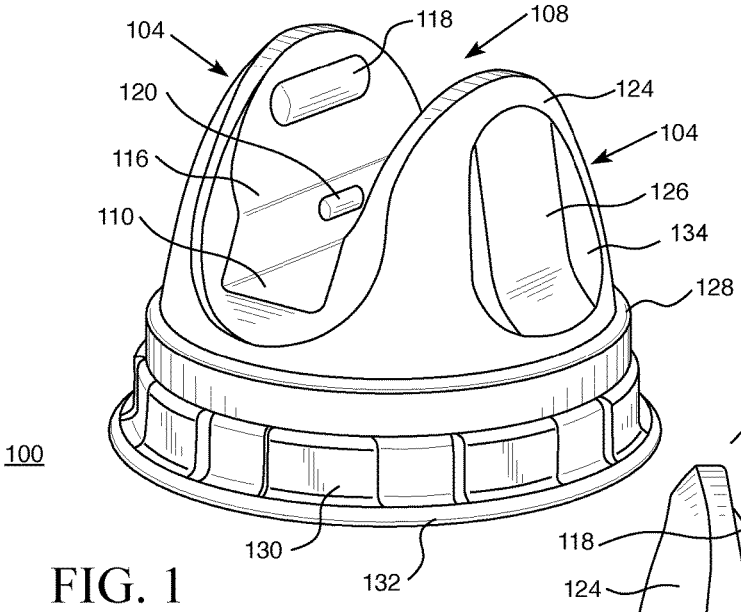
FIG. 1 is a front perspective view of one embodiment of the disclosed modular training device.
Figure 5:
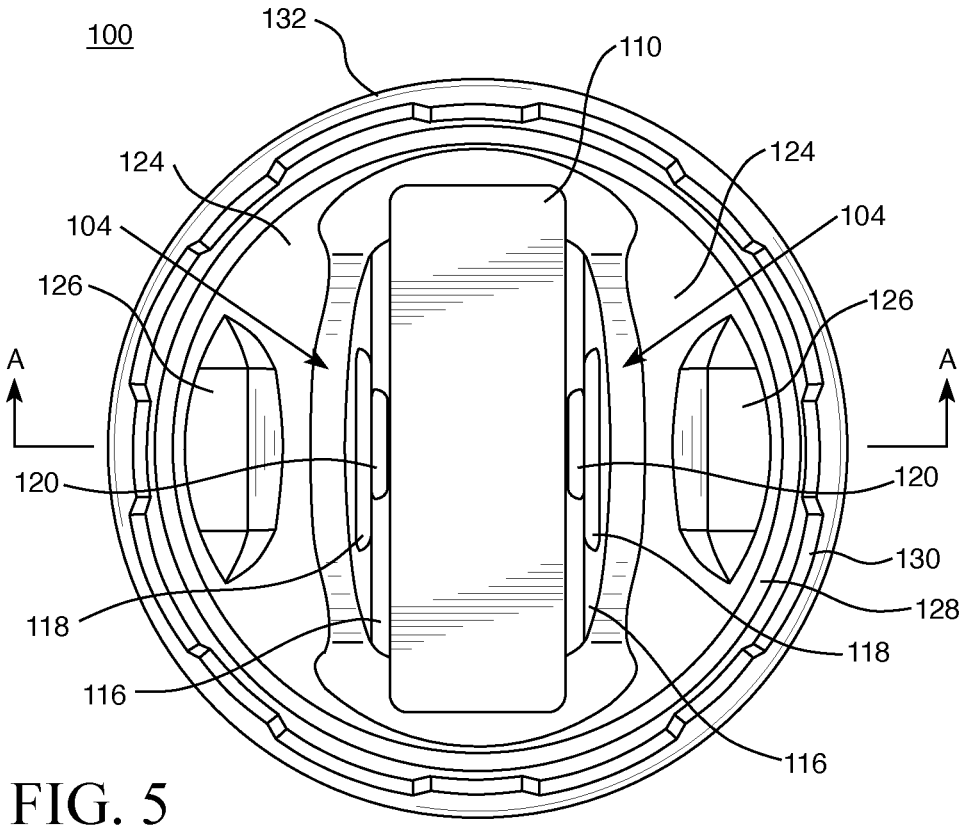
Figure 6:
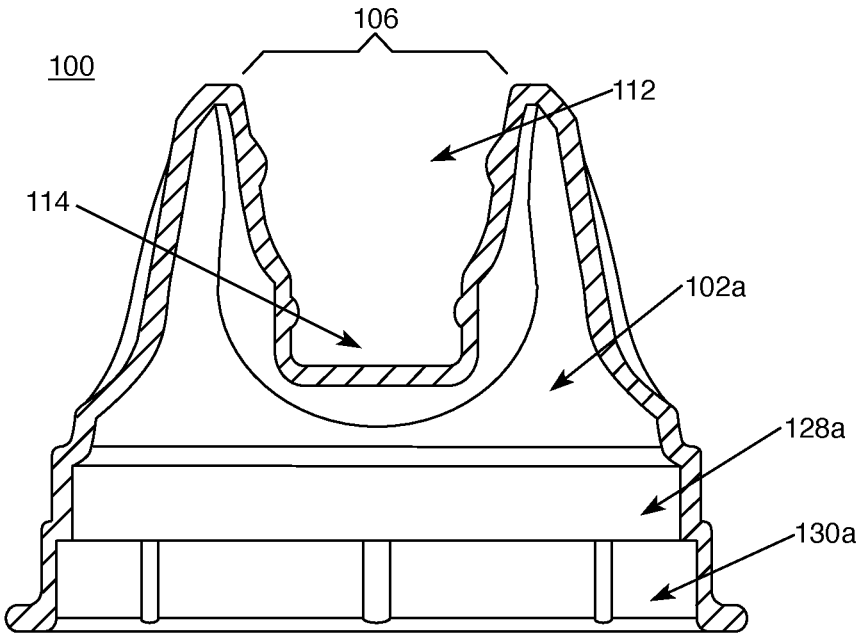
Figure 7:
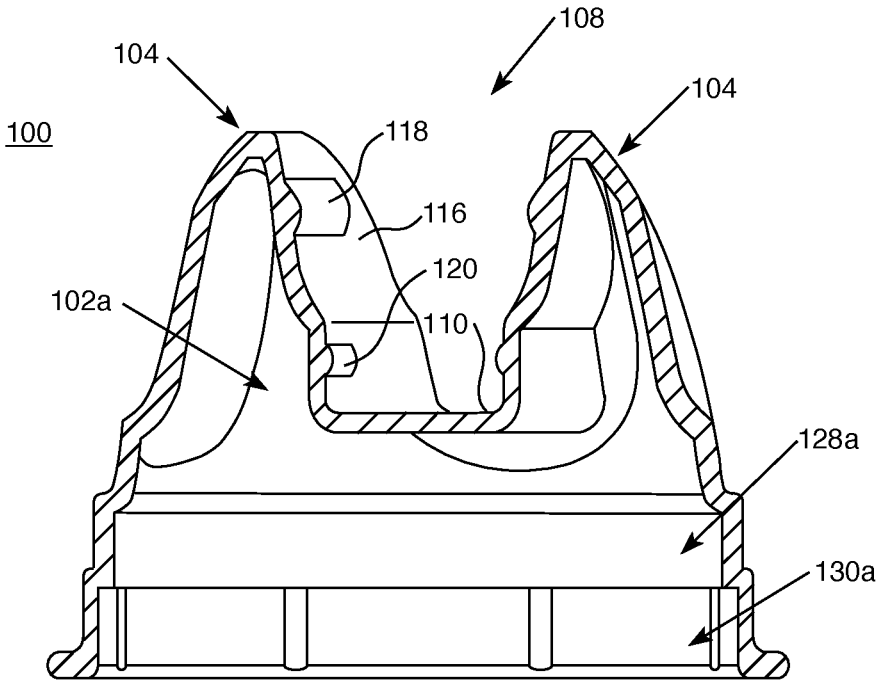
Figure 8:
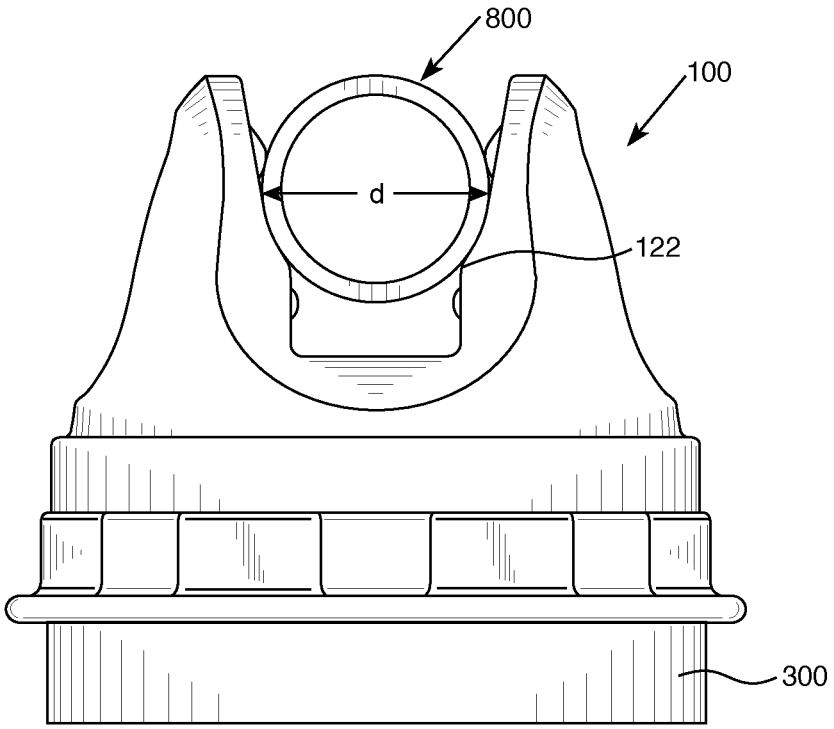
Figure 9:
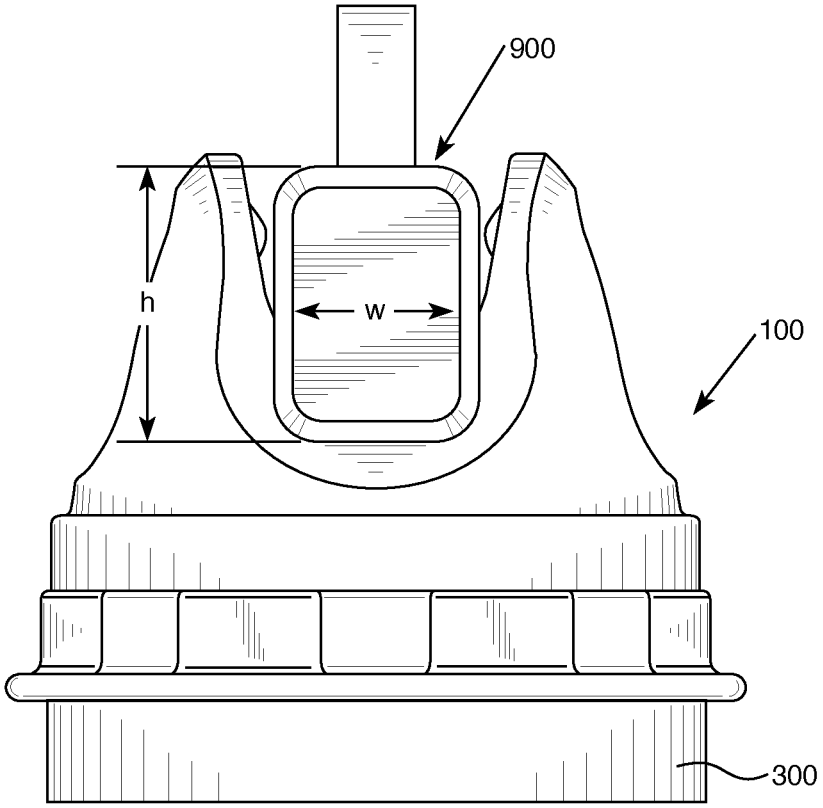
Figure 10:
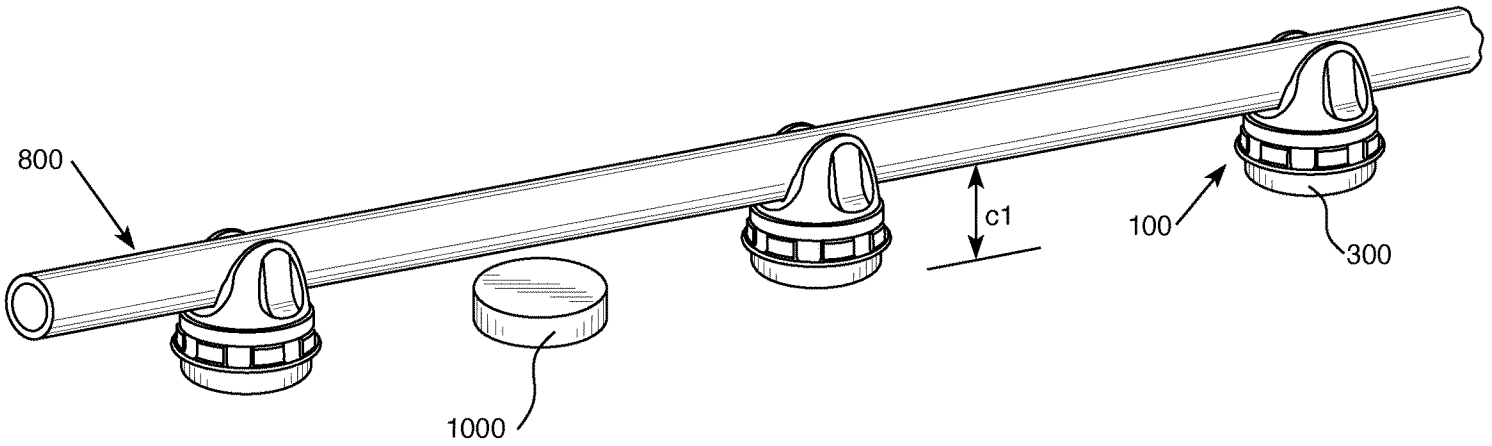
Figure 11:
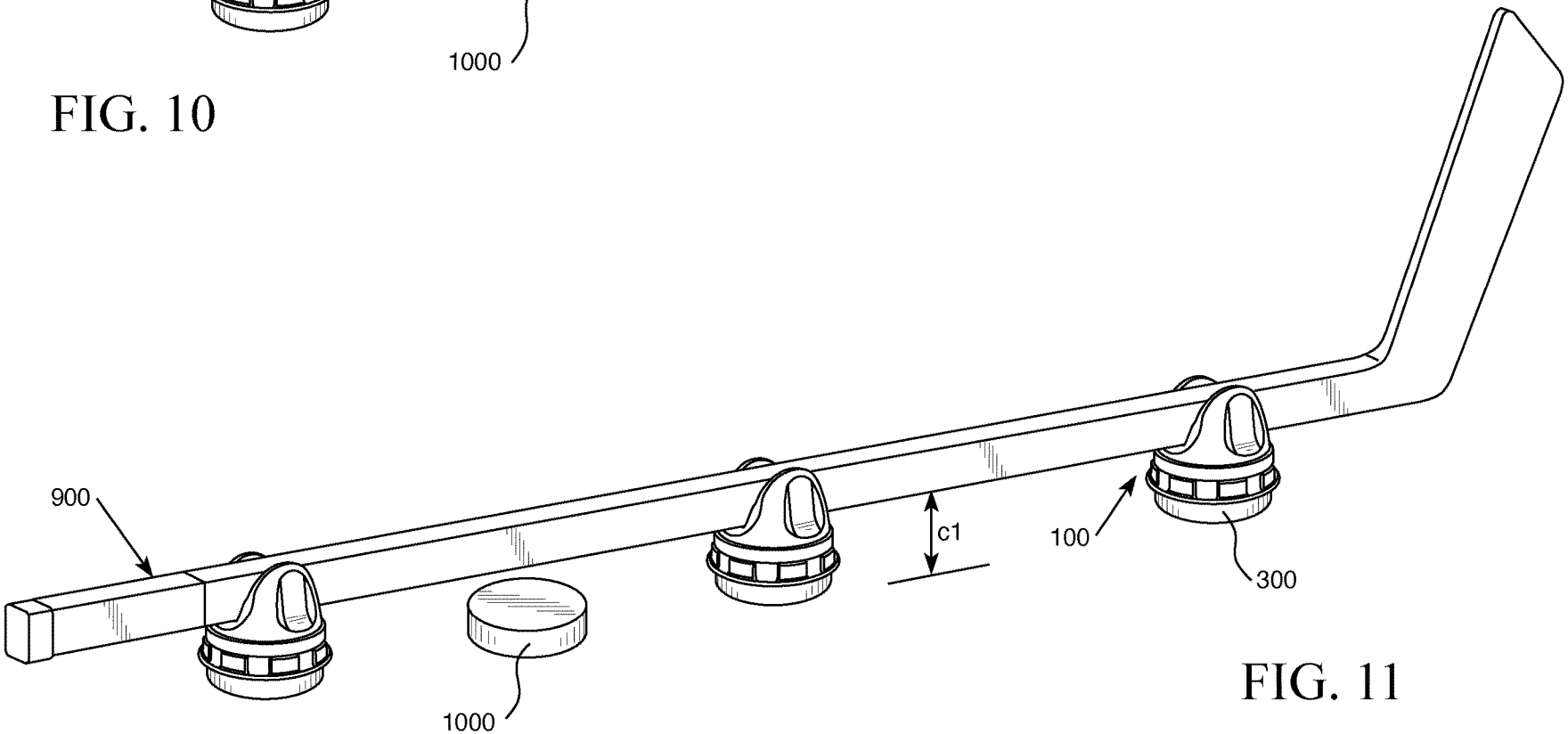
Figure 12:
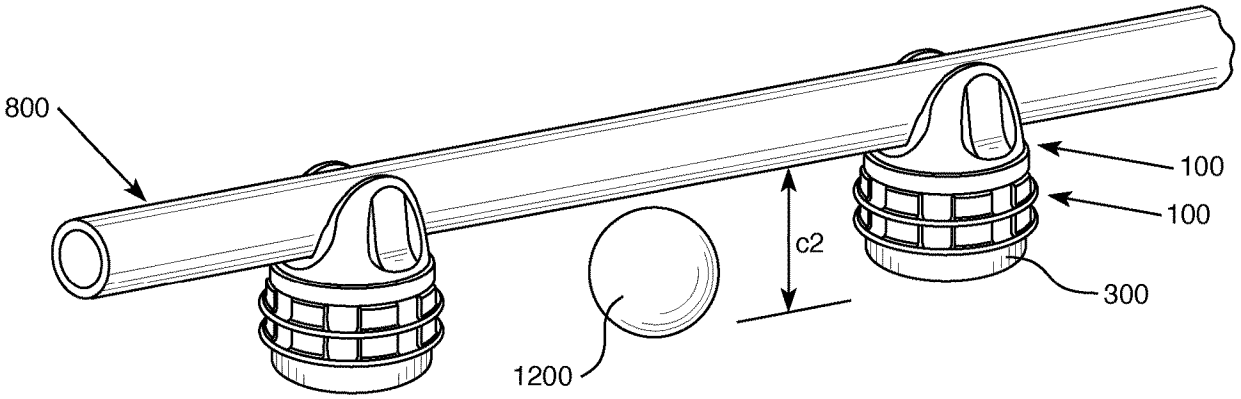
Figure 13:
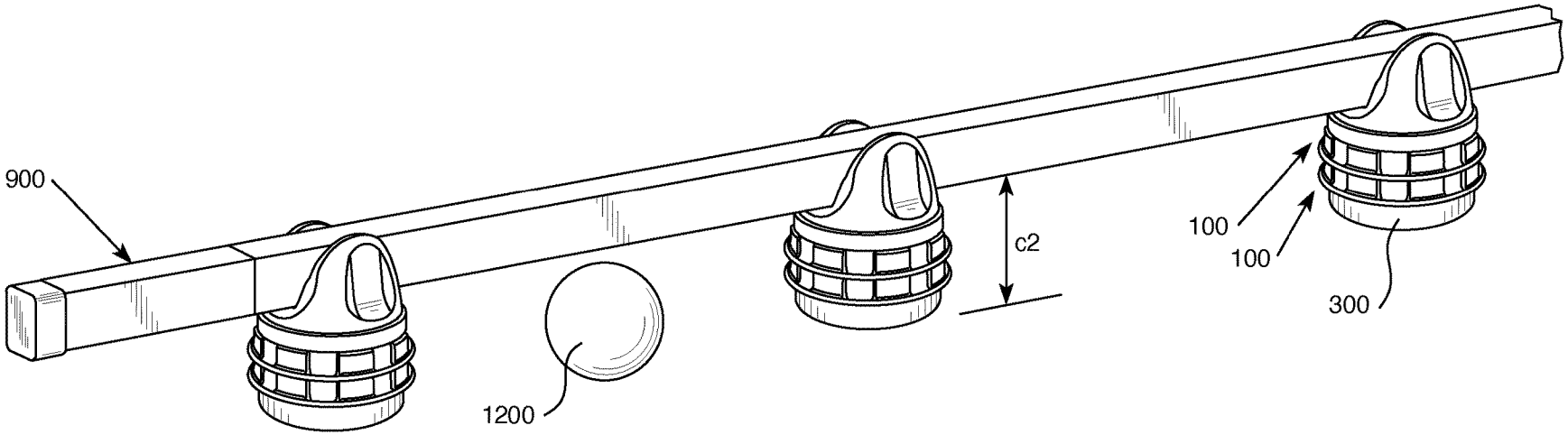
Figure 14:
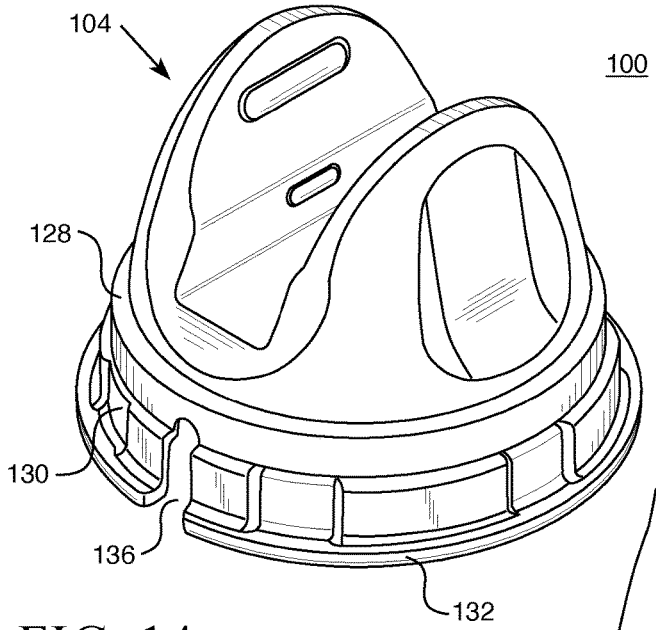
Figure 15:
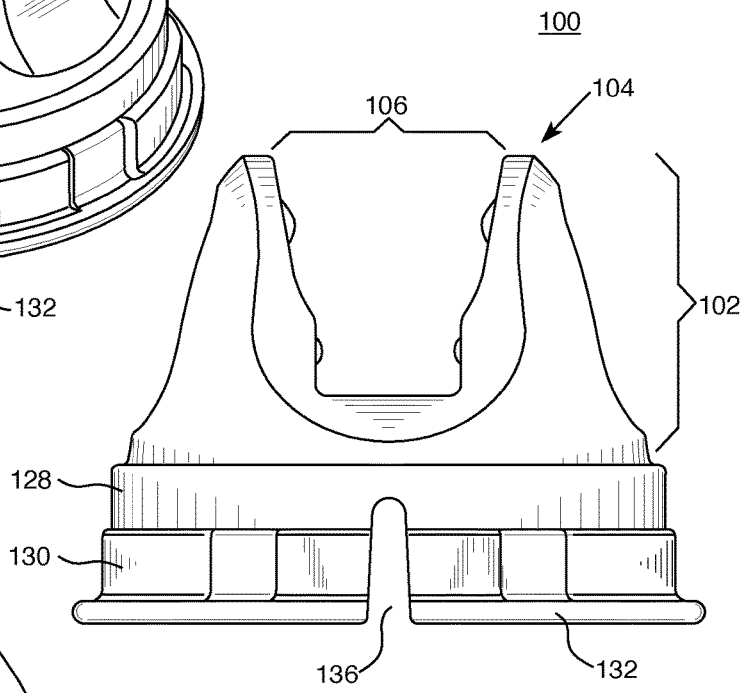
Figure 16:
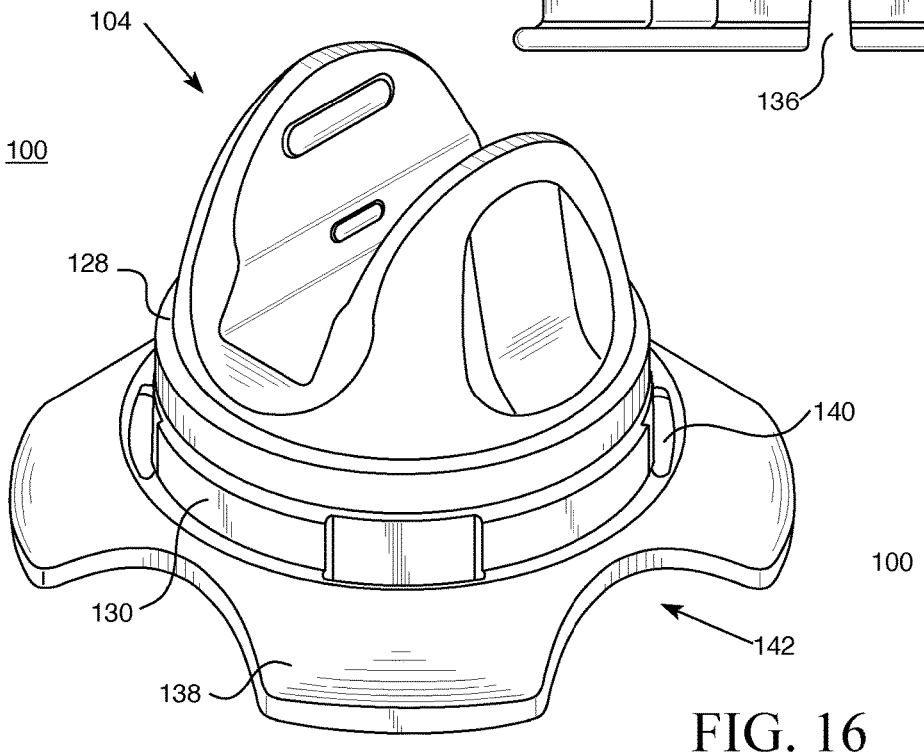
Figure 17:
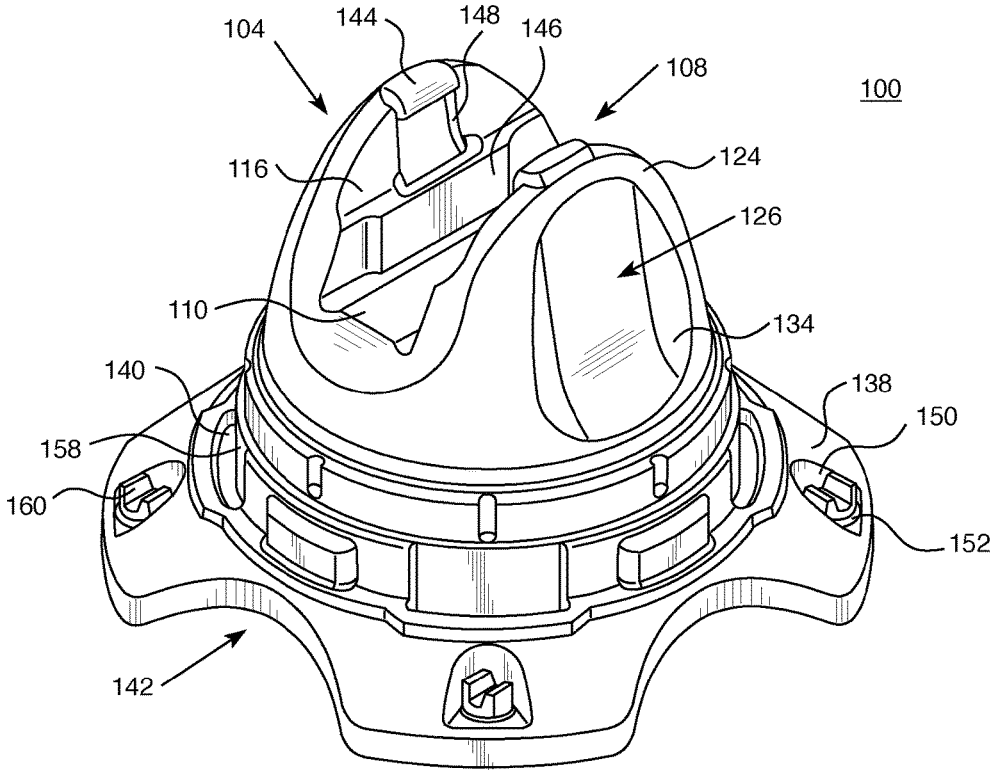
Figure 18:
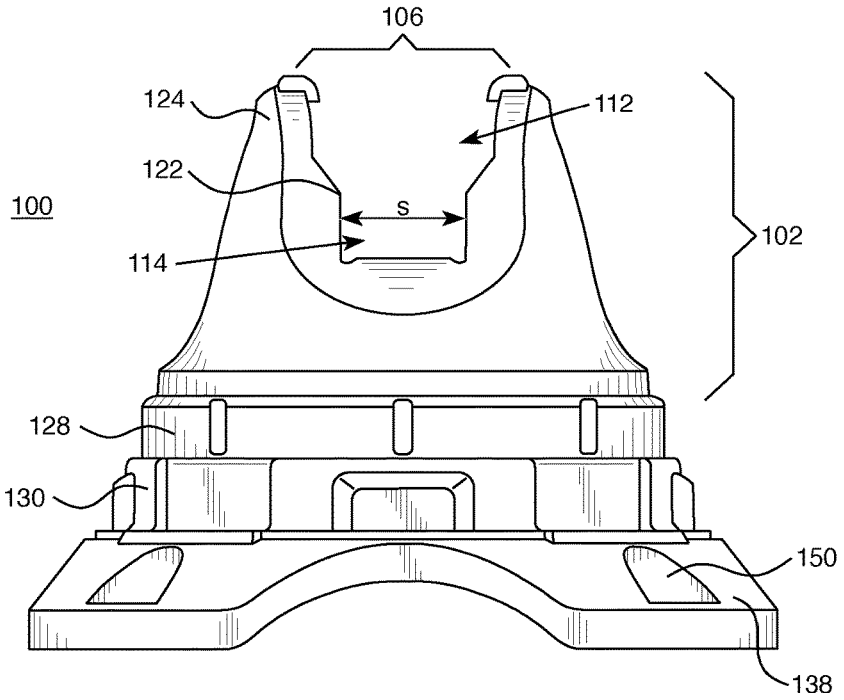
Figure 19:
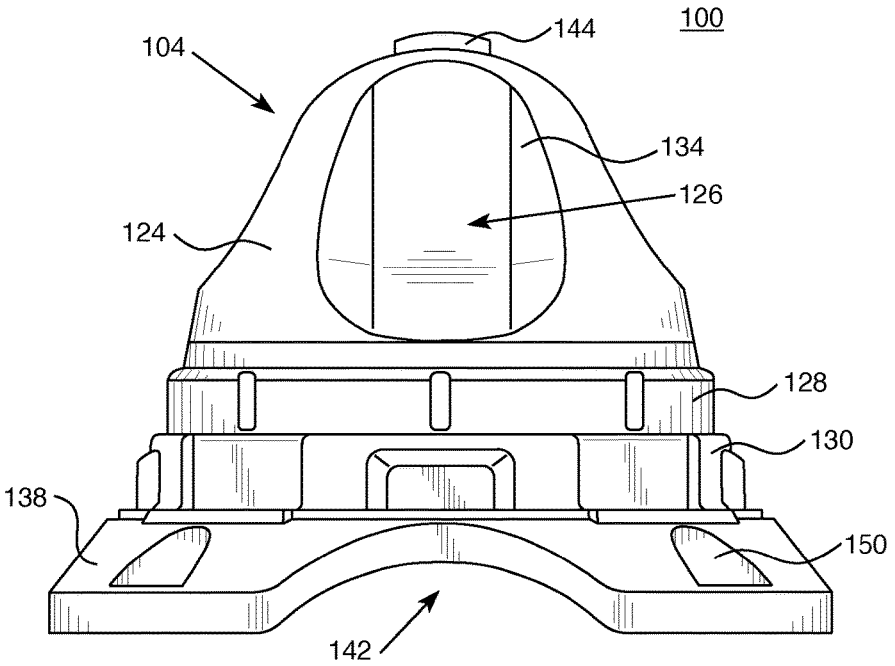
Figure 20:
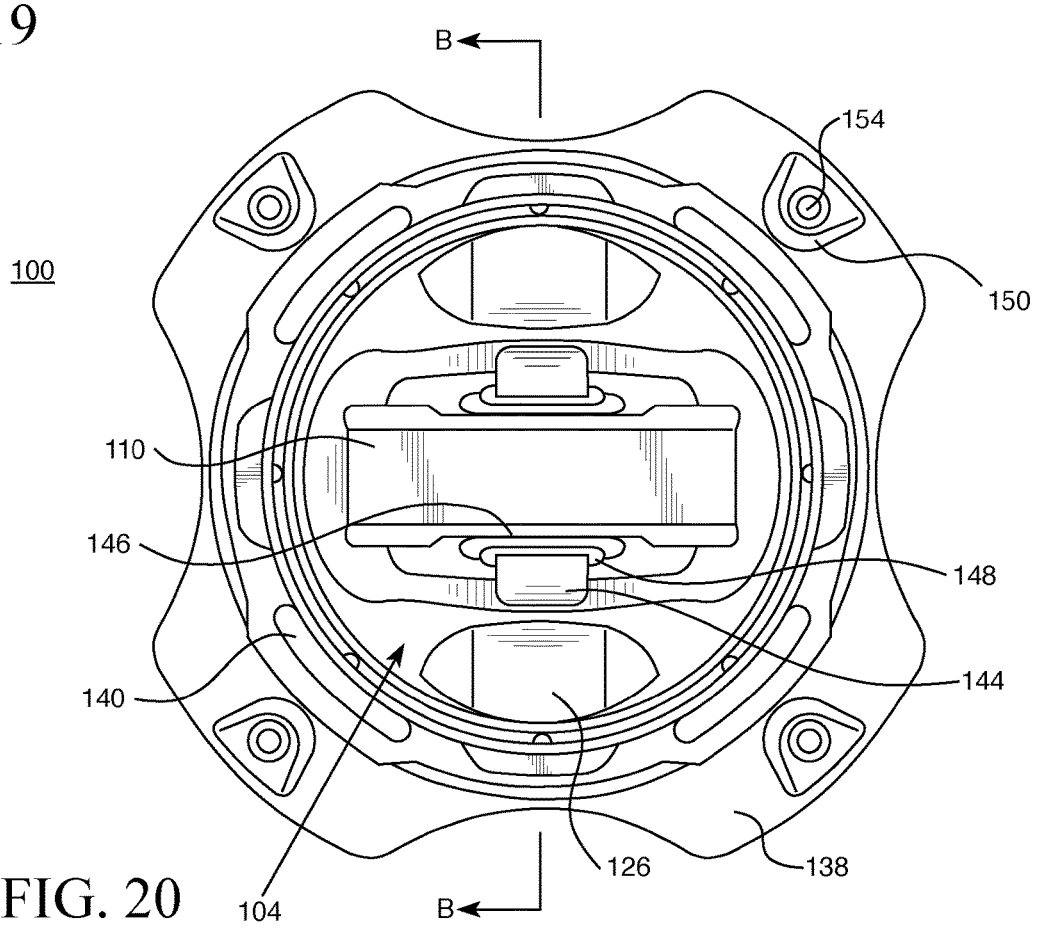
Figure 21:
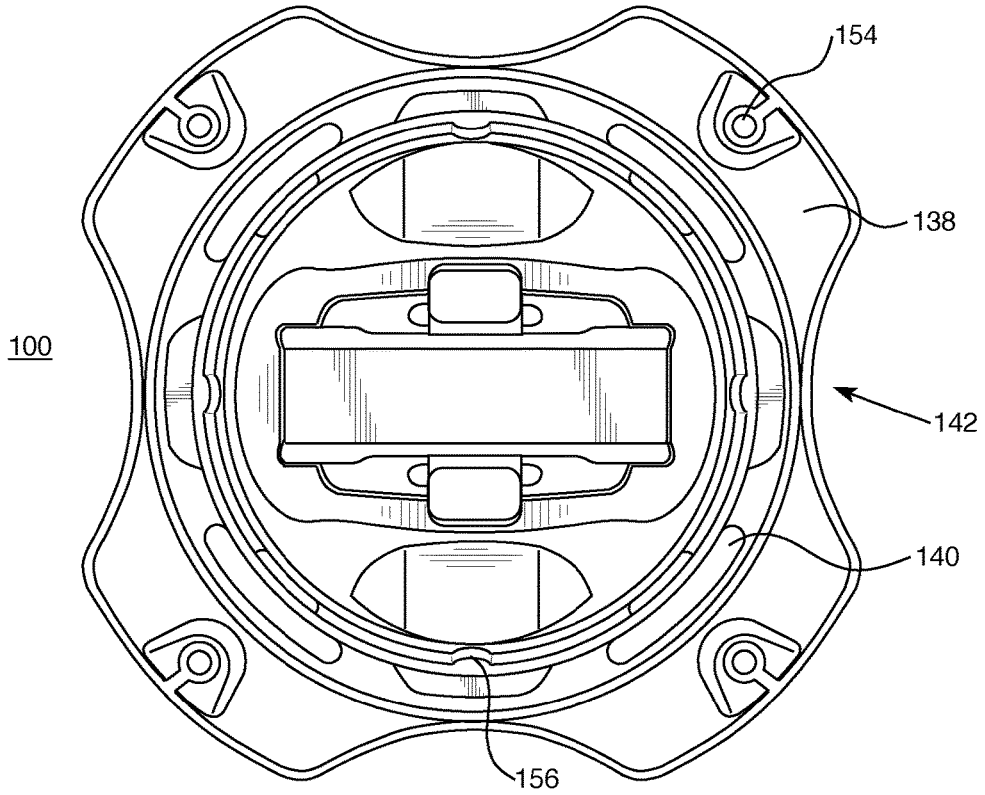
Figure 22:
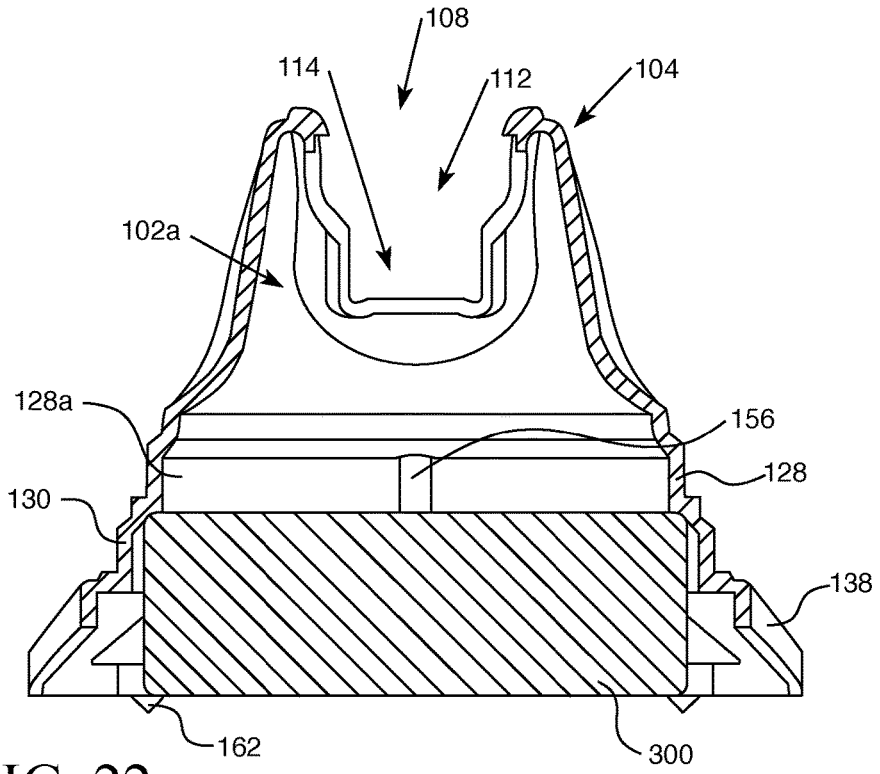
Figures 23, 24:
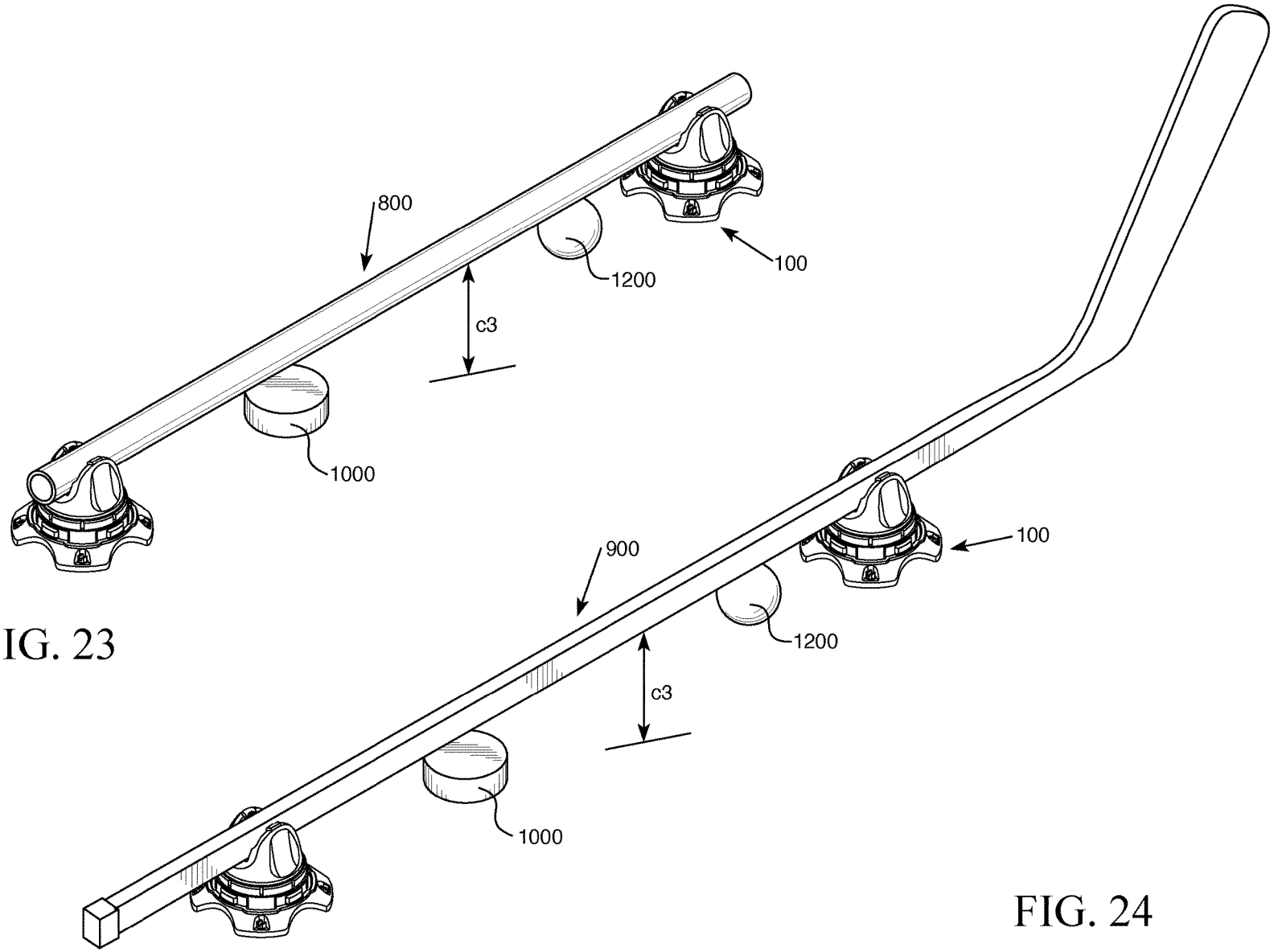
Figure 25:
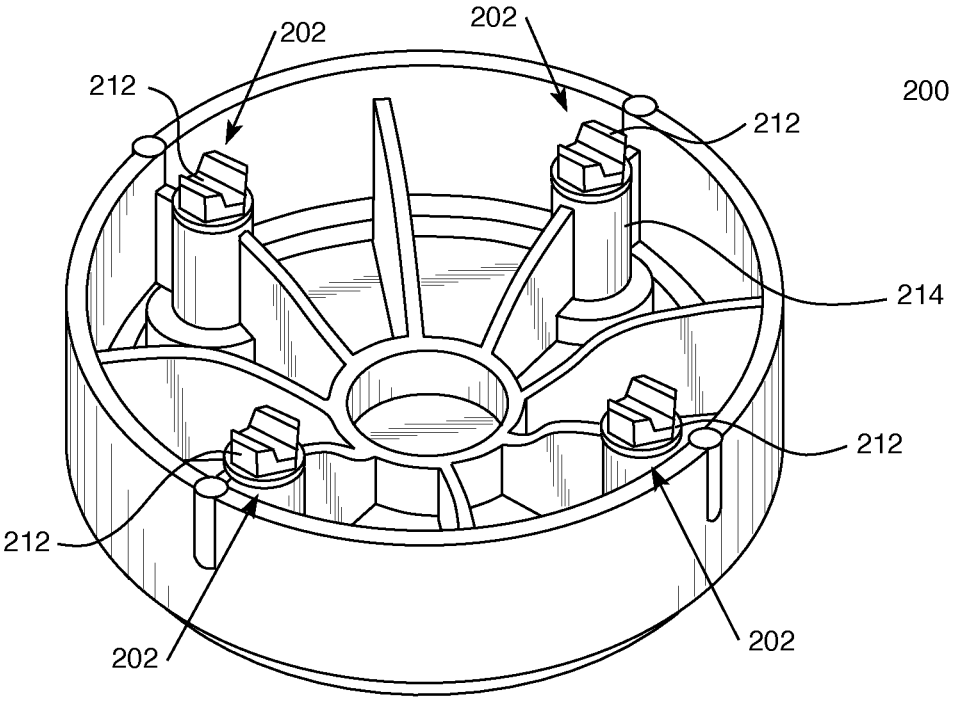
Figure 26:
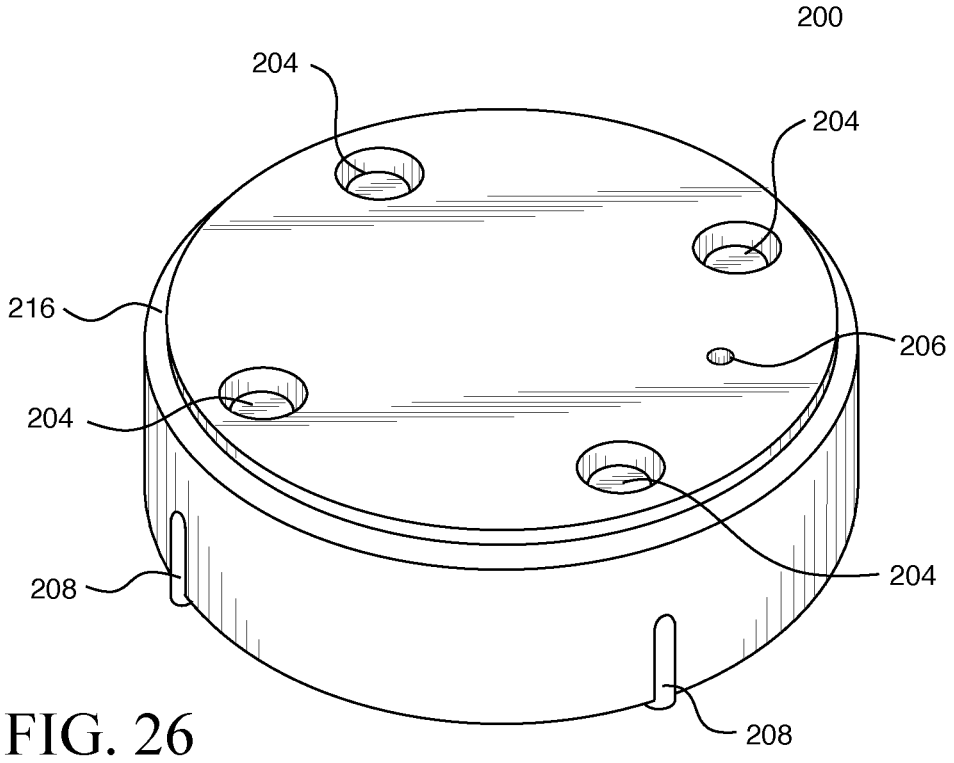

the left side elevational view is a mirror image of the right side elevational view;

FIG. 5 is a top plan view of the disclosed modular training device of FIG. 1;

FIG. 6 is a front cross-sectional view of the disclosed modular training device of FIG. 1 taken from the line A-A in FIG. 5; the back cross-sectional view is a mirror image of the front cross-sectional view;

FIG. 7 is a perspective cross-sectional view of the disclosed modular training device of FIG. 1 taken from the line A-A in FIG. 5;

FIG. 8 is a front elevational view of the disclosed modular training device of FIG. 1 when coupled with a hockey puck and a hollow pipe;

FIG. 9 is a front elevational view of the disclosed modular training device of FIG. 1 when coupled with a hockey puck and a hockey stick;

FIG. 10 illustrates one embodiment of the disclosed modular training device of FIG. 1 in use;

FIG. 11 illustrates one embodiment of the disclosed modular training device of FIG. 1 in use;

FIG. 12 illustrates one embodiment of the disclosed modular training device of FIG. 1 in use;

FIG. 13 illustrates one embodiment of the disclosed modular training device of FIG. 1 in use;

FIG. 14 is a front perspective view of a second embodiment of the disclosed modular training device;

FIG. 15 is a front elevational view of the disclosed modular training device of FIG. 14; the back elevational view is a mirror image of the front elevational view;

FIG. 16 is a front perspective view of a third embodiment of the disclosed modular training device;

FIG. 17 is a front perspective view of a fourth embodiment of the disclosed modular training device;

FIG. 18 is a front elevational view of the disclosed modular training device of FIG. 17; the back elevational view is a mirror image of the front elevational view;

FIG. 19 is a side elevational view of the disclosed modular training device of FIG. 17;

FIG. 20 is a top plan view of the disclosed modular training device of FIG. 17;

FIG. 21 is a bottom elevational view of the disclosed modular training device of FIG. 17;

FIG. 22 is a front cross-sectional view of the disclosed modular training device of FIG. 17 taken from the line B-B in FIG. 20; the back cross-sectional view is a mirror image of the front cross-sectional view;

FIG. 23 illustrates one embodiment of the disclosed modular training device of FIG. 17 in use;

FIG. 24 illustrates one embodiment of the disclosed modular training device of FIG. 17 in use;

FIG. 25 is a bottom perspective view of a fifth embodiment of the disclosed modular training device; and FIG. 26 is a top perspective view of the disclosed modular training devices of FIG. 25.

FIG. 27 illustrates an example use of the disclosed modular training devices, wherein a player path is shown weaving around each of the disclosed modular training devices.

FIG. 28 is a front elevational view of one embodiment of the disclosed modular training device paired with a second embodiment of the disclosed modular training device.

DETAILED DESCRIPTION

The present disclosure relates to training tools, and more particularly, relates to a modular training device and system for athletes. Various embodiments are described in detail with reference to the drawings, wherein like reference numerals may be used to represent like parts and assemblies throughout the several views. Reference to various embodiments does not limit the scope of the claims attached hereto. Examples of construction, dimensions, and materials may be illustrated for the various elements, but those skilled in the art will recognize that many of the examples provided herein have suitable alternatives that may be utilized. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

The disclosed device is a modular training device used by athletes, such as hockey players, to improve their stick-handling skills. For example, multiple devices can each be coupled with an elongated object, such as a hockey stick, to create a multi-barrier, bridged system around and under which an athlete can direct a hockey puck or training ball. More specifically, each of the devices can act as a riser to which a hockey stick or cylindrical pipe can attach. Therefore, in use, an athlete can attempt to direct a hockey puck past one or more of the devices and underneath the hockey stick or cylindrical pipe. For example, a set of devices could be lined up in a row, the hockey stick could couple with each device along its shaft length, and an athlete could weave the puck around each device while simultaneously keeping the puck on the ground so it does not make contact with the shaft of the hockey stick. Alternatively, an athlete could work on making passes on the ground by aiming to slot the puck between two devices and underneath the hockey stick. While not specifically described herein, other training drills are envisioned that could assist an athlete in improving stick-handling skills.

Figure 2:
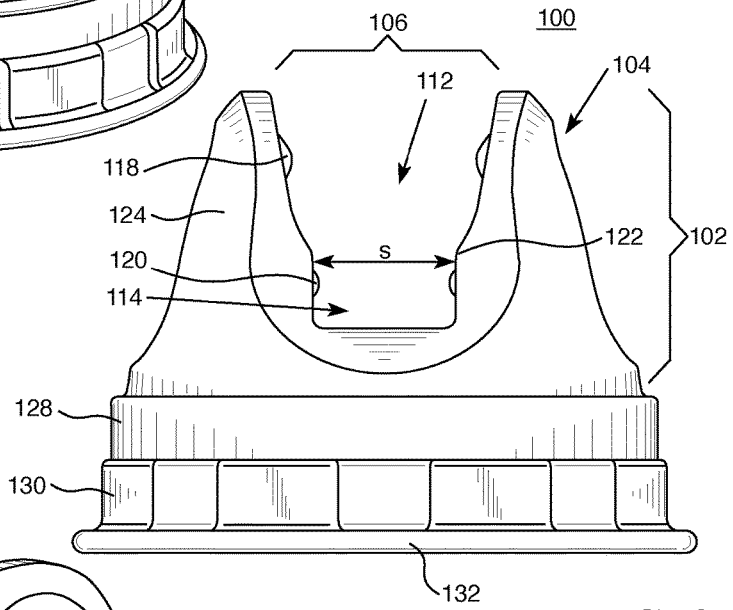
FIG. 2 is a front elevational view of the disclosed modular training device of FIG. 1; the back elevational view is a mirror image of the front elevational view.

More specifically, in some embodiments, the modular training device is a device comprising a main body and at least one base portion. For example, as illustrated in FIGS. 1-24, device 100 can include main body 102, which may, in some embodiments, form at least two vertical side projections 104. Side projections 104 can be positioned approximately parallel to each other and may define a gap or slot between them, such as central channel 106, with the central channel having top opening 108 and channel floor 110. In some embodiments, central channel 106 may also define upper cavity 112 and lower cavity 114 and may be open at the front and back of main body 102. Therefore, from a front view, as illustrated in FIG. 2, main body 102 may appear to approximately take the shape of a "U."

Figure 4:
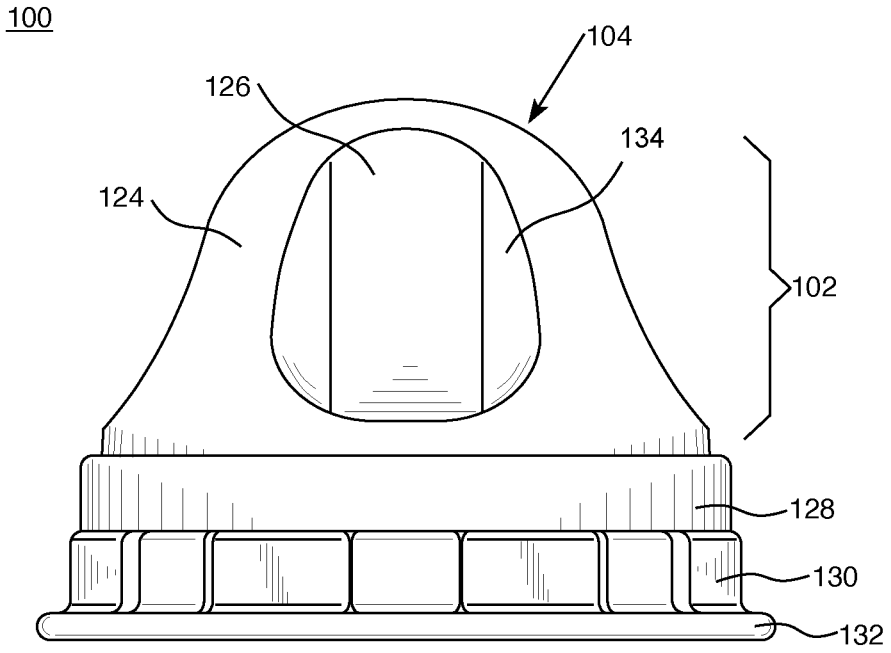
FIG. 4 is a right side elevational view of the disclosed modular training device of FIG. 1.

In use, side projections 104 are structured and configured to correspond to the profile of, and hold in place, an elongated object, such as cylindrical pipe 800 (for example, a PVC pipe) or hockey stick shaft 900, as illustrated in FIGS. 8 and 9, respectively. In some cases, objects other than pipe 800 or hockey stick shaft 900 can be used, such as a cylindrical or rectangular bar. For example, any elongated cylindrical or rectangular object having similar dimensions to that of pipe 800 and hockey stick shaft 900 can be couple with device 100 and used for training to improve stick-handling skills. As illustrated in FIG. 4, side projections 104 can project orthogonal to circular base portions 128, 130.

To securely couple the elongated object with device 100, main body 102 can further include one or more tabs on inner surface 116 of one or more of side projections 104, wherein the inner surfaces face each other. In some embodiments, main body 102 may have one tab on inner surface 116 of each side projection 104, and the tabs may project into central channel 106. In other embodiments, main body 102 may have two tabs on inner surface 116 of each side projection 104 that project into central channel 106 and, together, releasably secure an elongated object in a horizontal configuration within the central channel. For example, if main body 102 is structured and configured to couple with pipe 800 and hockey stick shaft 900, as illustrated in FIGS. 8 and 9, inner surface 116 may include two tabs: pipe tab 118/144 and shaft tab 120/146.

Accordingly, if, for example, main body is structured and configured to releasably secure pipe 800, as illustrated in FIGS. 8 and 23, inner surface 116 may include two pipe tabs 118/144, one on each side projection 104. In some embodiments, pipe tabs 118/144 can releasably secure pipe 800 in place in upper cavity 112 so the pipe does not uncouple from device 100 without substantial user force and effort. In some cases, pipe tabs 118 can be positioned above a horizontal pipe diameter d when pipe 800 is inserted, as illustrated in FIG. 8, and therefore act as a barrier to prevent pipe 800 and device 100 from separating. Pipe tabs 118 may be a raised bump located entirely on inner surface 116 and projecting into central channel 106, as illustrated in FIG. 2. Additionally, pipe tabs 118 may be rounded and beveled. In other cases, pipe tabs 144 may be hooked elements that project from top and inner portions of side projections 104, as illustrated in FIGS. 17-18. Further, pipe tabs 144 may be rounded on top and include a flat underside that projects into central channel 106 and creates a shelf to catch pipe 800, as illustrated in FIG. 23, and prevent the pipe from accidentally releasing.

In another example, if main body 102 is structured and configured to releasably secure hockey stick shaft 900, as illustrated in FIG. 9, inner surface 116 may include two shaft tabs 120/146, one on each side projection 104, as illustrated in FIGS. 7 and 17. When, for example, hockey stick shaft 900 is coupled with device 100, width w of the hockey stick shaft is similar to the width between shaft tabs 120/146 so that shaft tabs on inner surfaces 116 of side projections 104 can secure the hockey stick shaft in lower cavity 114. This may result in the shaft tabs creating a friction fit with shaft 900, as illustrated in FIG. 9, and preventing the hockey stick shaft from separating from device 100 without substantial user force and effort.

Figure 3:
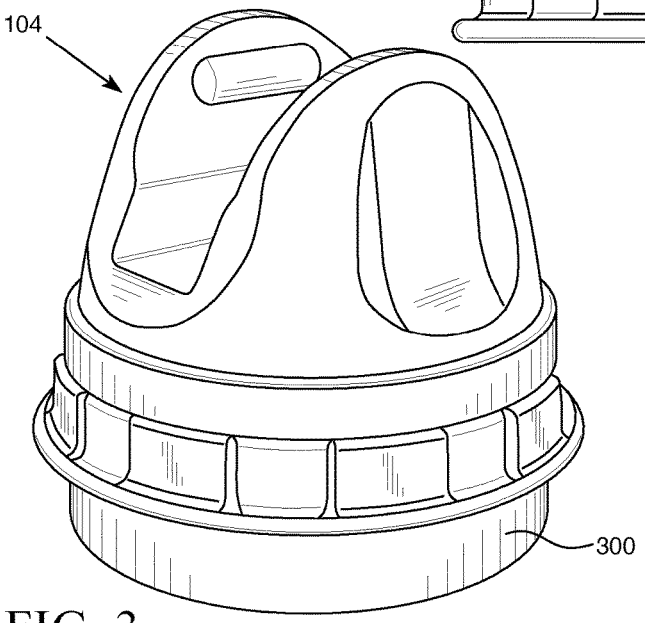
FIG. 3 is a front perspective view of the disclosed modular training device of FIG. 1 when coupled with a hockey puck.

In form, and as described above, tabs can have beveled edges. For example, tabs may be roughly circular and, therefore, have a dome-like shape. Alternatively, tabs 118, 120 may be more elongated and, therefore, have a cylindrical shape, as illustrated in FIGS. 1 and 3. In another case, tabs 146 may be elongated but have a rectangular shape with beveled edges, as illustrated in FIG. 17. Further, tabs may be made of semi-rigid material while also maintaining flexibility, which enables them to indent slightly when pipe 800, hockey stick shaft 900, or other elongated object are coupled and uncoupled from device 100. In some cases, each side projection 104 may have a cavity/open space behind the tabs to enable the tabs to flex when receiving or releasing an elongated object. In the case of tab 144, side projection may have cutout beneath the tab, such as cavity 148 of the side projection, as illustrated in FIG. 20, allowing the tab to flex down and, if necessary, into the cavity.

For example, as pipe 800 is inserted horizontally through top opening 108 and into upper cavity 112, pipe tabs 118/144 may indent or flex slightly to allow the pipe to pass. After pipe 800 passes the apexes of pipe tabs 118/144, pipe tabs may snap back into place, thus securing the pipe to device 100. Similarly, as hockey stick shaft 900 is inserted horizontally through top opening 108 and upper cavity 112 and into lower cavity 114, shaft tabs 120/146 may indent or flex slightly to allow shaft 900 to be inserted. However, if shaft tabs 120/146 are not located above height h of shaft 900, the shaft tabs may remain compressed, and the friction fit between shaft tabs 120/146 and the hockey stick shaft can keep the shaft releasably secured by device 100, as illustrated in FIG. 9.

In some embodiments, inner surface 116 can slant or slope inward to assist in creating a stopping point 122 for pipe 800. For example, as illustrated in FIGS. 2, 6, 8-9, 15, 18, and 22, inner surfaces 116 may slope inward until distance of separation s between each side projections' inner surface is approximately equal to, but slightly wider than, width w of hockey stick shaft 900. This enables device 100 to accommodate pipe 800, hockey stick shaft 900, or another elongated object in a horizontal position or configuration. More specifically, if user chooses to releasably secure pipe 800 to device 100, pipe can be wedged between pipe tabs 118/144 and stopping point 122, and if user chooses to secure shaft 900 to device, shaft can be freely inserted past stopping point 122 until shaft comes into contact with shaft tabs 120/146 and channel floor 110.

In addition to coupling with elongated objects, such as pipe 800 or hockey stick shaft 900, device 100 may couple with hockey puck 300, as illustrated in FIGS. 3, 8-9, and 22. One potential benefit of coupling device 100 with hockey puck 300 is that clearance height c1 will be greater than a height of hockey puck 1000, as illustrated in FIG. 10. Therefore, when, as described above, user is directing puck 1000 past one or more of devices 100 and underneath hockey stick shaft 900, puck 1000 is able to freely pass under shaft 900 as long as it is sliding on one of its two flat faces. Another potential benefit of coupling device 100 with hockey puck 300 is that the hockey puck will provide extra weight to prevent the device from unwanted excess movement.

To couple device 100 with hockey puck 300, hockey puck can be pressed into at least one hollow base portion so that an outer circumference of hockey puck 300 has a friction fit with an inner surface of at least one hollow base portion. Therefore, in some cases, in order to accommodate at least a portion of puck 300, device 100 can have a circular bottom face, and at least one hollow base portion, such as upper base portion 128 or lower base portion 130. In other cases, device 100 may, in addition to upper base portion 138 and lower base portion 130, have fins 138 projecting outwards from the lower base portion, and hockey puck 300 may be mostly or entirely covered by the fins, as illustrated in FIG. 22.

More specifically, as illustrated in FIGS. 6-7 and 22, device 100 may define a hollow interior **128*a* of upper base portion 128 and hollow interior 130*a* of lower base portion 130, and hockey puck 300, when inserted, may be disposed in either or both hollow interior 128*a* and 130*a*, and create a friction fit with the interior walls of the corresponding base portion 128 or 130 bounding the hollow interior. In some embodiments, as illustrated in FIGS. 21-22, upper base portion 128 may include stops 156 to prevent hockey puck 300 from extending into the hollow interior 128*a* of upper base portion 128. Additionally, lower base portions 130 may include tabs 158, as illustrated in FIG. 17, to grip hockey puck 300 once inserted and can flex a distance between its inner surface and the inner surface of the remaining wall. Stops 156 and tabs 158 can project inward from the upper and lower base portions 128, 130 toward the hollow interior of device 100. In some embodiments, stops 156 may project further inward or may be less flexible than tabs 158 so as to keep hockey puck 300 in lower hollow interior 130*a* and to prevent the hockey puck from proceeding up into upper hollow interior 128*a***.

Additionally, to accommodate variations in hockey puck sizes, device 100 may be structured and configured to include one or more vertical slits 136 in any of base portions 128, 130 or lip 132, as illustrated in FIGS. 14-15. Vertical slits 136 can provide additional flexibility to base portions 128, 130 and lip 132, so one or more of base portions and/or lip can more readily expand when needed to couple with hockey puck 300. For example, vertical slits 136 can enable device 100 to have a diameter sized slightly smaller than hockey puck 300, therefore enabling a tighter grip on the hockey puck when the two objects are paired together.

In another embodiment, as illustrated in FIGS. 16-24, device 100 may accommodate variations in hockey puck sizes as well as provide stability to the device and puck combination to prevent tipping of the device when in use. For example, device 100 may include a set of fins 138 to provide stability and relief apertures, such as horizontal slits 140, to accommodate variations in hockey puck sizes.

Fins 138 can project radially outward from the base portion and/or lip at a roughly perpendicular angle to the longitudinal device axis or at a non-perpendicular angle, such as one greater than 180 degrees, as illustrated in FIG. 18. In some cases, fins 138 can replace lip 132. Additionally, fins 138 may be structured and configured to include horizontal slits 140 near their connection points to the base portion. Horizontal slits 140 can be shaped to curve along the base of fins 138, as illustrated in FIGS. 16 and 20-21. Therefore, instead of vertical slits, device 100 may be structured and configured to include one or more horizontal slits 140 between each fin 138 and the hollow base portion, such as the lower base portion 130, as illustrated in FIGS. 16 and 20-21. Horizontal slits 140 can, similarly to vertical slits, provide flexibility to base portions 128, 130 and fins 138 so that base portions and fins can more readily expand and contract when needed (for example, to couple with hockey puck 300). As with vertical slits 136, horizontal slits 140 can enable device 100 to have a diameter sized equal to or slightly smaller than hockey puck 300, therefore enabling a tighter grip on the hockey puck when the two objects are paired together.

As illustrated in FIG. 20, there can be four fins 138. However, the number of fins 138 is not limited to four. In some cases, there can be one fin 138 that projects out around the entire circumference of the device 100. In other cases, there can be two or more fins 138. While it is envisioned, in one embodiment, that a plurality of fins 138 will be equally spaced out, it is not required, and it is possible that fins 138 may even be of varying sizes themselves. Similarly, horizontal slits 140 can be spaced equidistant or at various distances from each other and may be of the same or varying sizes.

As illustrated in FIGS. 16-21, some embodiments of device 100 include a curved or arced gap 142 between each fin 138. To accommodate gaps 142, horizontal slits 140 can have a length shorter than the length of the portion of fin 138 where it meets base portion 130. This enables device 100 to include gaps 142 between fins 138 while maintaining fins' connection with the base portion and allowing the device to maintain the ability to accommodate various puck sizes.

In some embodiments, fins 138 may, in addition to providing stability due to an increased horizontal profile size, be structured and configured to suction to the ground to ensure device 100 does not tip over when it is not coupled with hockey puck 300. In other embodiments, fins 138 may include attachment points for securing each fin to a surface to keep it in place. More specifically, attachment points may enable device 100 to adhere to ground surface, such as dirt or ice, and/or to a wall surface. When secured or adhered to a ground surface, device 100 can be used for training, as described above. When secured or adhered to a wall surface, device 100 can be used for storage of elongated objects, such as sports sticks (for example, hockey or lacrosse) or pipes.

As illustrated in FIGS. 17 and 20-21, attachment points may be comprised of cavity 150 on each fin 138, and the cavity can include a hole 154 into which a fastener can be received and inserted. In some cases, the fastener can be an ice spike 152. In other cases, the fastener can be a nail or a drywall screw and anchor. The cavity 150 on fin 138 can be sunken, as illustrated in FIGS. 17-19 so that only a minimum portion of the fastener remains above the surface when the fastener is inserted and secured. Further, the fastener can then minimally protrude, if at all, above the cavity after securing device 100 to the surface. As illustrated in FIG. 22, when the fastener is ice spike 152, a bottom portion of each ice spike can extend past the bottom plane of fins 138 in order to make contact with ice or any other firm ground surface such as, but not limited to, dirt, grass, turf, etc. Similarly, a nail or screw can also extend past the bottom plane of fins 138.

In addition to creating clearance height c1, coupling hockey puck 300 with device 100 can add mass to device 100 and improve the ability of device 100 to act as a base for an elongated object as well as a barrier for user. Therefore, when training with device 100 that is coupled with hockey puck 300, it may be more difficult for a user to accidentally move or knock over device 100 than if device was being used without hockey puck 300. This is especially true if device 100 is secured to the ground with fasteners.

To separate device 100 from hockey puck 300, the device can be deformable so a user may squeeze side projections 104 inward. This action may result in a gap or separation between a portion of the outer circumference of hockey puck 300 and the inner surface of the hollow base portion, which can reduce the friction between device 100 and the hockey puck. This reduction in friction may allow a user to pull hockey puck 300 free from device 100 and thereby separate the objects from each other. Another feature that may assist with coupling or separation of device 100 and hockey puck 300 is a textured surface of lower base portion 130, illustrated in FIGS. 1-4, wherein the textured surface can include alternating protrusions around the circumference of lower base portion 130. For example, a user may gain a better grip on device 100 by gripping textured surface of lower base portion 130. This improved grip can help a user either push device 100 onto puck 300 or pull the device off of the puck. The textured surface can also incorporate tabs 158 as they have been described above and illustrated in FIG. 17.

To further enhance the ease with which a user can separate the device 100 and hockey puck 300, the outer surface 124 of a side projection 104 can define an indented grip portion 126, as illustrated in FIGS. 1, 3-5, 14, 16-17, and 19-21. Grip portion 126 may have a rounded and vertically elongated shape to ergonomically accommodate a user's fingers and make the separation process easier. To enhance the ergonomics further, side projection 104 may have a rounded top. This combination of side projection's rounded top and elongated shape of grip portion 126 can make it intuitive and easy for user to grab device 100 at grip portion 126 and squeeze side projections 104 together.

Indented grip portion 126 may also have sloped or beveled side edges 134, as illustrated in FIGS. 1 and 17, to help guide a user's finger down into the center depression of grip portion where squeezing will be most effective for the action of separating device 100 and hockey puck 300. Beveled side edges 134 can also help prevent a user's finger from slipping out of grip portion 126 since, to slip out, user's finger would have to slide up from the center depression of grip portion and over the beveled side edges. To further prevent user's finger from sliding out of grip portion 126, all or a portion of grip portion (for example, the center depression area) may have a textured surface. Additionally, vertical slits 136 and horizontal slits 140 may provide enough initial separation from puck 300 to assist a user in fully separating device 100 from the puck.

In addition to coupling with elongated objects, such as pipe 800 or hockey stick shaft 900, and hockey puck 300, two or more devices 100 may couple with each other. The configuration of each device 100 enables a user to stack multiple devices 100 together for easy transportation. Another benefit of stacking multiple devices 100 together, aside from easy transportation, is that a resulting height of stacked devices may accommodate training with different types of equipment. For example, as mentioned above, coupling one device 100 with puck 300 and pipe 800 or shaft 900 may create a clearance height c1 tall enough for hockey puck 1000 to freely slide underneath the pipe or shaft, as illustrated in FIGS. 10 and 11. Extending this idea further, coupling multiple devices 100 with each other, with puck 300, and with pipe 800 or shaft 900 may create a clearance height c2 that is tall enough for ball 1200 to slide or roll underneath the pipe or shaft, as illustrated in FIGS. 12 and 13. Further, in other embodiments, a single device 100 may have clearance height c3 that is tall enough for puck 1000 and ball 1200 to freely slide or roll underneath pipe 800 or shaft 900, as illustrated in FIGS. 23-24.

Therefore, to enable devices 100 to couple with each other, a portion of at least one of the devices may be hollow. In some cases, an entirety of a device 100 is hollow, as illustrated in FIGS. 6-7 and 22. Therefore, when devices 100 couple with each other, side projections 104 of a first device can slide into hollow interior **102*a* of the main body of a second device and can nestle into the hollow interior of the main body of second device. Alternatively, hollow interior 102*a* of a main body of first device can be placed over the top of a second device and the second device can be twisted around until side projections 104 of the second device properly align with the hollow interior of the main body of first device, and therefore the first device can slide entirely on top of the second device. Once coupled, lip 132 (or fins 138) of an upper device may rest on top of lower base portion 130 of a lower device, as illustrated in FIGS. 12-13. In an alternate configuration, lips 132 or fins 138 of each device 100** may be nestled on top of each other with contact made between each device's lips or fins.

There is no limit envisioned in regard to the number of devices 100 that can be stacked; any device can simultaneously nest with additional devices on its bottom and/or its top, although in some circumstances it may only nest with a second device on one or the other side. Further, while hollow versions of device 100 have been described herein, it is envisioned that, in some cases, only a portion of the device may be hollow while still maintaining devices' ability to couple with each other. Alternatively, some embodiments of the device may be solid and, therefore, may only couple with a hollow version if the hollow version of the device is placed on top of the solid version, or the solid version may not couple at all with other devices or with hockey puck 300. In this case, the increased weight of the solid nature of device may offset its inability to couple with hockey puck 300. Further, if the device is solid, it may also have a taller circular base portion so that it can maintain its ability to act as a base for an elongated object while permitting puck 1000 or ball 1200 to freely slide or roll underneath the elongated object.

To further help a user separate devices 100 from each other when the devices do not have fins 138, lip 132 may protrude out slightly from each device to provide a surface and ledge for user to grab or hook a finger underneath. Additionally, as described above, a user may squeeze grip portions 126 on each side projection 104 inward toward each other and into the central channel 106. This action can result in a gap or separation between a portion of the outer surface of the lower device and the inner surface of the upper device, which can reduce the friction between the lower and upper devices. This reduction in friction may allow a user to pull the devices apart and thereby separate the devices from each other.

In addition to coupling with elongated objects, such as pipe 800 or hockey stick shaft 900, hockey puck 300, and two or more devices 100 with each other, device can couple with disc 200. Disc 200 can be comprised of a puck-shaped main body, ice spikes 202, stacking dimples 204, a vent hole 206, and alignment ribs 208, as illustrated in FIGS. 25-26. More specifically, disc 200 can be a short cylinder having a mostly flat, top surface, a relatively smooth outer circumference, and an open underside, as illustrated in FIGS. 25 and 26. In some embodiments, the top surface of disc 200 can be crowned or pointed like a cone to enable a user to more easily see it on the ice.

Ice spikes 152 and 202 can project out from the underside of device 100 and disc 200, respectively, and can be structured and configured to penetrate ice and prevent device and disc from sliding out of place when another object, such as, but not limited to, a hockey puck, hockey stick, or person, makes contact with it. Ice spikes 152, 202 can be elongated objects having a peg (not illustrated) with pointed tip 162 and grip 160, 212, as illustrated in FIGS. 17, 22 and 25. For example, ice spikes 152, 202 can be ice screws. The peg of each spike can be secured in fitted housing 214, as illustrated in FIG. 25, and grip 212 can project out slightly from the bottom plane of disc 200, as illustrated in FIG. 22. In this case, fitted housing 214 can be a molded portion of disc 200. Alternatively, each peg can be a molded portion of disc 200 instead of securing to fitted housing 214. In some embodiments, as described above, the peg can insert through hole 154 in fin 138, and grip 160 can act as a stopper to prevent ice spike 152 from sliding entirely through the hole. The peg can be long enough that pointed tip 162 is the only portion of the peg to project out from the bottom plane of device 100. In some embodiments, each device 100 and disc 200 can have four ice spikes 152, 202. However, any number of ice spikes 152, 202 can be used for each device 100 or disc 200.

Each grip 160, 212 can be structured to have two prongs, as illustrated in FIGS. 17 and 25, although any number of prongs is possible (for example, one centered prong or three prongs equidistant from each other). The prongs can be rigid and can be sharp enough to penetrate ice, thereby allowing disc 200 to anchor itself to ice and prevent movement even when contact is made with it by another object. The prongs can also make it easier for a user to easily grab ice spike 152, 202 and separate ice spike from device 100 or disc 200.

While a bottom of fitted housing 214 may be open to allow grip 212 to protrude out from the bottom of disc 200, a top of the fitted housing can be closed and can be structured so it is below the flat, top surface of disc. This configuration enables each disc 200 to have stacking dimples 204 on the flat, top surface directly above a corresponding ice spike 202, as illustrated in FIG. 26. Therefore, the number of stacking dimples 204 can correspond to the number of ice spikes 202 in disc 200. Stacking dimples 204 can be roughly circular and can have a slightly wider diameter than ice spikes 202, which enables ice spikes 202 to fit into stacking dimples 204 when multiple discs 200 are stacked on top of each other.

In addition to stacking dimples 204, the top surface of disc 200 may have one or more vent holes 206. A purpose of vent hole 206 is to prevent disc 200 from locking up in device 100 or a second disc. Therefore, vent hole 206 can be an aperture through the flat, top surface of the main body that creates an opening to allow free air exchange from the top surface of disc 200 through to the bottom of disc. Vent hole 206 can be relatively small in diameter so it does not impede the structural integrity of disc 200, and it can be incorporated into a design on the top face of disc.

As with device 100, the ability for discs 200 to stack together enables a user to easily transport discs. When stacking multiple discs 200 together, alignment ribs 208 and disc lip 216 can visually and physically assist a user with properly aligning the stacked discs. Each disc 200 can have one or more alignment ribs 208 as illustrated in FIGS. 25-26. Alignment ribs 208 can be elongated bumps on the otherwise smooth outer circumference of disc 200. When stacking multiple discs 200 together, a user can visually align alignment ribs 208 from a first disc with alignment ribs from a second disc.

To further assist a user with aligning discs 200 during stacking, lip 216 can physically assist a user. More specifically, the relatively flat, top surface of disc 200 may have a smaller diameter than the smooth, outer circumference and, therefore, lip 216 may be formed along the outside of the flat, top surface, as illustrated in FIG. 26. When stacking two discs 200 together, the bottom portion of the outer circumference of the top disc can align on lip 216 of the bottom disc and be prevented from shifting horizontally due to the flat, top surface of the bottom disc acting as a stop.

In one embodiment, a group of devices 100 and/or discs 200 can be comprised of multiple colors to assist with training. More specifically, using devices 100 and/or discs 200 of different colors, a coach can set up the devices/discs in a specific pattern and instruct players to weave around them in a specific color sequence. For example, the coach may use one color (for example, yellow) as a starting color and may then instruct players to navigate around two other colors (for example, green and red) in an alternating pattern, as illustrated in FIG. 27 wherein the player path 2700 is shown. Spikes 152, 202 enable devices 100 and discs 200 to stay in place even if players run into one or more devices or discs with their hockey puck or ball, hockey stick, or their own person.

As mentioned above, disc 200 can also couple with device 100, as illustrated in FIG. 28. More specifically, the external diameter of disc 200 can correspond to the internal diameter of lower base portion 130, allowing a user to insert disc into device 100. Additionally, lip 216 can prevent disc 200 from sliding further into device 100. This results in the bottom surface of disc 200 aligning with the bottom surface of device 100 and, therefore, allows ice spikes 202 to project out from the bottom plane of the device, as illustrated in FIG. 28. Being able to couple disc 200 to device 100 in this way enables device to exclude ice spikes 152 from its design yet still benefit from ice spikes 202 so it can resist moving when impacted. When removing disc 200, a user can reach through gap 142 to grasp the exposed outer circumference of the disc. As when multiple discs are stacked together, vent hole 206 can prevent disc 200 from locking up in device 100.

As briefly mentioned above, some embodiments of the disclosed device may be made of a semi-rigid material so that it retains some flexibility. More specifically, device 100 and disc 200 may be made of injection-molded polypropylene. In other embodiments, device 100 and disc 200 can be made of injection-molded polyethylene, thermoplastic polymers (for example, ABS), or glass-filled polymers or plastics (for example, glass-filled polyamide). While specific materials are disclosed herein, other thermoplastic polymers or plastics could also be used.

Persons of ordinary skill in arts relevant to this disclosure and subject matter hereof will recognize that embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments. Moreover, elements described with respect to one embodiment can be implemented in other embodiments even when not described in such embodiments, unless otherwise noted.

For purposes of interpreting the claims, it is expressly intended that the provisions of 35 U.S.C. 112(f) are not to be invoked unless the specific terms "means for" or "step for" are recited in a claim.

What is claimed is:

1. A modular training device comprising:

a main body comprising at least two side projections that are structured and configured to together define a central channel therebetween, wherein:

the central channel has a top opening and a channel floor;

each side projection has a first tab projecting into the central channel for releasably securing an elongated object in a horizontal configuration within the central channel; and the central channel is comprised of an upper cavity and a lower cavity, the lower cavity being narrower than the upper cavity; and at least one hollow base portion located below the main body.

2. The modular training device of claim 1, wherein the first tab on each projection is projecting into the central channel from an inner surface of the side projection.

3. The modular training device of claim 1, wherein the first tab from each projection is located in the upper cavity and the two first tabs are together configured to releasably secure a cylindrical pipe.

4. The modular training device of claim 1, wherein the first tab from each projection is located in the lower cavity and the two first tabs are together configured to releasably secure a hockey stick shaft.

5. The modular training device of claim 1, wherein:

each side projection has a second tab projecting into the central channel;

the first tab from each projection is projecting into the upper cavity;

the second tab from each projection is projecting into the lower cavity;

the two first tabs are together configured to releasably secure a cylindrical pipe; and the two second tabs are together configured to releasably secure a hockey stick shaft.

6. The modular training device of claim 1, wherein the at least one hollow base portion is circular and is structured and configured to releasably couple with a hockey puck via an interference fit.

7. The modular training device of claim 1, wherein the modular training device is configured to nest with a second modular training device by fitting inside of the second modular training device.

8. The modular training device of claim 1, wherein the main body is hollow, and the modular training device is configured to nest with a second modular training device by stacking on top of and over the second modular training device.

9. The modular training device of claim 1, further comprising a set of fins projecting outwards from a lower portion of the at least one hollow base portion.

10. The modular training device of claim 9, wherein each fin from the set of fins includes an attachment point for securing each fin to a surface.

11. The modular training device of claim 10, wherein the attachment point includes a cavity having a hole and the hole is configured to receive a fastener.

12. The modular training device of claim 11, wherein the fastener is an ice spike.

13. The modular training device of claim 9, further comprising a relief aperture between each fin and the lower portion of the at least one hollow base portion.

14. The modular training device of claim 1, wherein each side projection is comprised of an indented grip portion formed on an outer surface of each side projection.

15. A modular training device comprising:

a main body comprising:

at least two side projections that, together, form a central channel, wherein the central channel has a top opening, an upper cavity, a lower cavity, and a channel floor at the base of the central channel, and the at least two side projections are structured so that the lower cavity is narrower than the upper cavity;

an inner surface on each of the at least two side projections, wherein the inner surfaces face each other;

a first tab on each of the inner surfaces of the at least two side projections, wherein each of the first tabs project into the upper cavity; and a second tab on each of the inner surfaces of the at least two side projections, wherein each of the second tabs project into the lower cavity;

an upper base portion positioned below the main body;

a lower, hollow circular base portion positioned below the upper base portion; and a set of fins projecting outward from a bottom-most portion of the modular training device;

wherein:

at least one base portion is configured to couple with a hockey puck; and the central channel is configured to couple with at least one of a hockey stick shaft and a pipe.

16. A method of using a modular training device system, the method comprising:

coupling each of one or more modular training devices with a corresponding hockey puck, wherein each of the one or more modular training devices comprises:

a main body having a central channel, wherein the central channel is comprised of an upper cavity and a lower cavity, the lower cavity being narrower than the upper cavity; and at least one hollow base portion configured to releasably couple with the hockey puck;

coupling a hockey stick shaft with the central channel of each of the one or more modular training devices, wherein a first height is a distance between a ground-facing surface of the hockey stick shaft and a bottom face of the hockey puck.

17. The method of claim 16, further comprising coupling each of the one or more modular training devices with an additional, at least one corresponding modular training device by stacking each of the one or more modular training devices on top of the additional, at least one corresponding modular training devices to create a second height, wherein:

the second height is a distance between the ground-facing surface of the hockey stick shaft and the bottom face of the hockey puck; and the second height is greater than the first height.

18. The modular training device of claim 1, wherein the two first tabs are together configured to releasably secure a hockey stick shaft.

19. The modular training device of claim 1, wherein the at least one hollow base portion includes at least one attachment point for securing the device to a surface, each attachment point includes a cavity having a hole, and the hole is configured to receive a fastener.

* * * * *